United States Patent [19]

Stokes

[11] 4,333,323

[45] Jun. 8, 1982

[54] WASHING MACHINE

[75] Inventor: Vijay K. Stokes, Schenectady, N.Y.

[73] Assignee: General Electric Company, Louisville, Ky.

[21] Appl. No.: 216,119

[22] Filed: Dec. 15, 1980

[51] Int. Cl.[3] ..... D06F 21/06

[52] U.S. Cl. ..... 68/171

[58] Field of Search ..... 68/171–174, 68/23 R, 152–154

[56] References Cited

U.S. PATENT DOCUMENTS

| | | | |
|---|---|---|---|
| 1,665,959 | 4/1928 | Graham et al. | 68/174 X |
| 1,764,476 | 6/1930 | Smith et al. | 68/174 |
| 2,119,918 | 6/1938 | Kirby | 68/154 X |
| 2,344,253 | 3/1944 | Kirby | 68/23 R X |
| 2,658,372 | 11/1953 | Kirby | 68/23.2 |
| 4,252,005 | 2/1981 | Stokes | 68/172 |
| 4,254,642 | 3/1981 | Stokes | 68/172 |

*Primary Examiner*—Philip R. Coe

*Attorney, Agent, or Firm*—Radford M. Reams

[57] ABSTRACT

A fabric washing machine includes a receptacle to receive washing liquid and a fabric article load to be washed in the liquid. The receptacle includes a generally upright outer wall and a generally upright center post spaced radially inward of the outer wall. The outer surface of the center post is textured to minimize slippage between the center post and fabric articles. The outer wall and center post are interconnected by a bottom wall having an upper surface textured to maximize slippage with the fabric articles. The upper surface of the bottom wall is contoured to slope downwardly substantially continuously from the outer wall to the center post and to undulate circumferentially of the receptacle.

4 Claims, 7 Drawing Figures

WASHING MACHINE

BACKGROUND OF THE INVENTION

1. Field of the Invention

This invention relates to machines for washing fabrics, such as clothes, and more particularly to such machines employing an orbital motion of the fabric receptacle during the agitation mode, that is during the washing and rinsing portion of the cycle of operation of the washing machine.

2. Description of the Prior Art

Conventional household clothes washing machines are of the vertical-axis agitator type and are usually rather large and complex. In such machines, there is generally provided a cabinet enclosing a water-retaining tub in which is disposed an inner fabric-receiving receptacle or basket. An agitator is mounted within the basket. The agitator and basket are coupled to a suitable power transmission driven from an electric motor. The transmission converts the high speed rotary motion of the motor to a rotary speed appropriate for centrifugal extraction of water from fabrics in the basket and to a slower oscillatory motion of the agitator during the washing and rinsing portions of the operating cycle of the machine. Such machines usually include a water pump for recirculating water within the machine and a filter for separating out lint or other particles from the recirculated water. Inherently, such machines use large amounts of water. Also there is a high energy interface between the fabrics being washed and the oscillating agitator. Many such machines have vibration and traveling problems resulting from imbalances in the machine, particularly during centrifugal water extraction or spinning operation. Such machines have frequently required complex suspension systems and often the basket is provided with an annular balance ring in a further effort to alleviate the vibration and traveling problems.

Various alternatives have been proposed to simplify such washing machines and to eliminate or reduce some of the problems referred to above. One such alternative arrangement is that illustrated and described in application, Ser. No. 039,406, filed May 15, 1979 and in copending Continuation-in-Part application, Ser. No. 142,949, filed Apr. 23, 1980, for John Bochan and assigned to the assignee of the present invention.

The washing machine illustrated and described in those aforementioned applications is of the vertical-axis type wherein the receptacle or basket is driven during the agitation modes, that is during the washing and rinsing portions of the cycles of operation, in such a manner that the basket moves in an orbital path. The basket is restrained from rotating about its own axis while being orbited. After the washing or rinsing action has been completed, provision is made for substantially aligning the basket axis with the axis about which it was orbiting, and the basket is then rotated about this latter axis to centrifugally extract water from the fabric load. In the structure of the aforementioned applications, outer wall of the basket is provided with a plurality of inwardly extending vertical ribs and with a plurality of inclined vanes for effecting movement of the fabric load during the washing and rinsing operations and to more effectively remove soil from the fabrics being washed.

An improvement in one aspect of the aforementioned applications is illustrated and described in copending application of Everett Morey et al., Ser. No. 172,092, filed July 25, 1980 and assigned to the assignee of the present invention. The basket structure of the Morey et al. application includes a plurality of annular ledges formed on a downwardly and outwardly sloping portion of the bottom of the basket. These ledges act in cooperation with ribs formed on the circumferentially outer side wall of the basket and with inclined ramps provided adjacent to the outer side wall of the basket to effect an improved washing operation. Another improvement on the basket of the aforementioned Bochan applications is illustrated and described in the copending application of John Bochan, Ser. No. 196,803, filed Oct. 14, 1980 and assigned to the assignee of the present invention. The basket structure of the latter Bochan application includes a plurality of spaced ramps formed adjacent the outer side wall of the basket at the bottom portion thereof and inclined upwardly in a direction opposite to the orbiting direction of the basket. A vertical wall is provided adjacent the inner edge of each of the ramps. Each wall extends above the surface of the associated ramp. The walls cause increased movement of the fabrics engaging the wall, enhancing turnover of the fabric load and redistribution of the fabrics within the load. Each of the ramps is formed to include an inclined section between the top of the wall and the adjacent upper ramp surface to minimize wedging of fabrics between the ramp wall and side wall of the basket.

The present invention constitutes another improvement in the construction of baskets for use in washing machines of the vertical-axis orbiting basket type.

Accordingly, it is an object of this invention to provide a washing machine including an improved fabric receiving receptacle for effecting washing motion of the fabrics within the receptacle or basket during the washing and rinsing operation and to provide for effective turnover and redistribution of the fabrics within the load during the washing and rinsing operation.

SUMMARY OF THE INVENTION

In carrying out the invention, and one form thereof, a fabric receptacle or basket is formed to include a generally upright or vertical circumferentially outer wall and a generally upright or vertical center post spaced radially inwardly of the outer wall. The outer surface of the center post is constructed and arranged for engaging fabric articles during washing and rinsing operations and is textured to minimize slippage between the outer surface and the fabric articles. The basket also includes an annular bottom wall interconnecting the lower ends of the outer wall and the center post. The upper or inner surface of the bottom wall is textured to maximize slippage between the upper surface and the fabric articles. The upper surface is contoured to slope downwardly substantially continuously from the outer wall to the center post and to undulate circumferentially of the receptacle.

DETAILED DESCRIPTION OF THE PREFERRED EMBODIMENT

Figure 1:
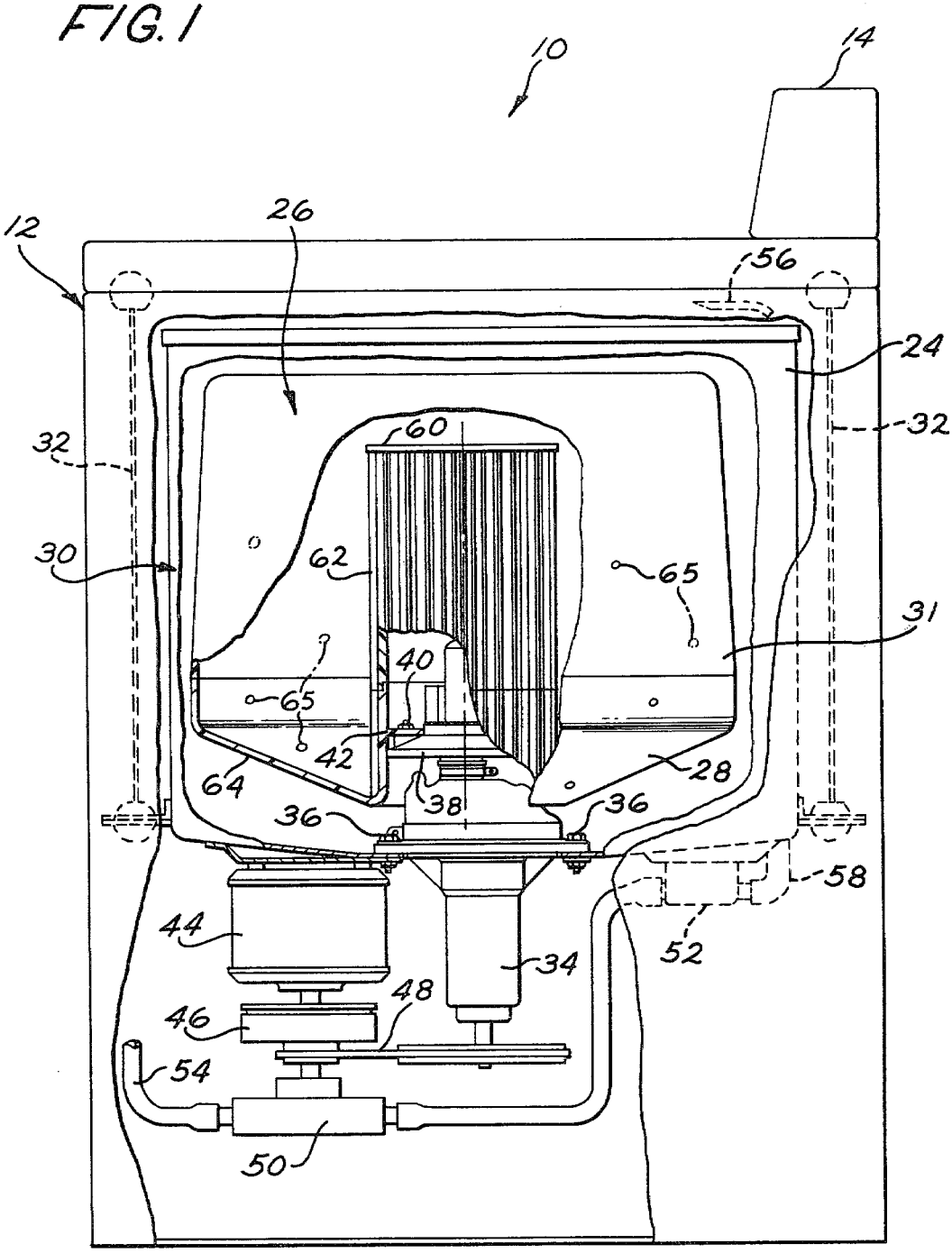
FIG. 1 is a simplified, somewhat schematic elevational view, partly in section, of a washing machine incorporating an embodiment of the present invention, with some components omitted for the sake of simplicity.

Referring now to the drawings, and particularly to FIG. 1, there is shown a washing machine 10 of the vertical-axis type which includes a cabinet 12. The cabinet includes a control panel 14 which is normally provided with a plurality of switches and controls employed by the user for selecting and initiating a sequence of operation. An access lid, not shown, is hinged in the top of the cabinet for movement between open and closed positions to provide access to the interior of the washing machine.

Within the cabinet there is disposed an imperforate stationary tub or casing 24. Within this tub there is disposed a basket or receptacle 26 for receiving fabric articles, such as clothing, to be washed. The basket 26 is intended to be of relatively light weight and may be molded, for example, from a plastic material such as polypropylene. In the particular form shown the basket is of two-piece construction and includes a bottom 28 and a body 30. The bottom 28 and body 30 are formed with interengaging shoulders and may be joined into a unitary basket by means of any liquid bonding agent suitable for use with plastic and applied at the interengaging shoulders. The circumferential outer or side wall 31 of the basket is formed, in part, by the bottom 28 and, in part, by the body 30.

The tub 24 is suspendedly mounted on the cabinet 12 by three rods, two of which are illustrated at 32 in FIG. 1. A transmission 34 is mounted in an opening in the bottom of tub 24 and secured to the tub by means of a plurality of bolts 36. Transmission 34 includes a collar 38 and basket 26 is mounted on this collar in driving relationship with the transmission by bolts 40, extending through a central flange 42 of the basket and received in the collar 38. The basket 26 is driven through the transmission 34 by means of a reversible electric motor 44 connected to the transmission through a suitable load-limiting clutch 46 and a belt 48.

The transmission 34 is illustrated only generally and may be of the general type illustrated and described in the aforementioned application, Ser. No. 142,949. With the transmission there disclosed, when the motor 44 is rotated in one direction the transmission causes the central axis of the basket 26 to orbit about the axis of the input shaft of the transmission in a substantially horizontal plane, the basket itself being prevented from rotating about its own axis. Conversely, when the motor 44 is rotated in the opposite direction the transmission substantially aligns the axis of the basket 26 with the axis of the input shaft to the transmission so that the basket rotates about its own axis at a high speed for centrifugal extraction of liquid from the fabrics in the basket.

The electric motor 44 is also arranged to drive a pump 50 for withdrawing liquid from a sump 52 and discharging it through a hose 54 to a suitable drain (not shown). The particular form of the pump 50 is not important so long as the pump withdraws liquid from the tub in response to rotation of the motor 44 in either direction.

The washing machine 10 is a fresh-water flow-through machine. It includes water supply means schematically illustrated by nozzle 56. Conveniently the water supply means may be in the form shown and described in copending application, Ser. No. 142,949, which is adapted to be connected to sources of hot and cold water and is positioned to provide water both directly to the basket and to an appropriate treating agent dispensing structure. The water supply means includes solenoid valves for selectively allowing water to enter the machine. A water level switch, not shown, which may be of any type well known in the art, is connected through an air chamber mechanism 58 to the sump 52. As water accumulates in the sump, the air in chamber 58 is compressed and closes the water level switch to turn off the supply of water. The particular details of the water supply and discharge system are not critical to the present invention. The elements and their operation are described more fully in the aforementioned applications.

The present invention is directed more particularly to the structure of the fabric-receiving receptacle or basket shown in detail by FIGS. 2–7 taken in conjunction with FIG. 1. The side wall 31 is generally vertical in configuration, although it may be canted slightly inwardly as illustrated in order to provide more clearance between the top of the basket 26 in the upper portion of the tub 24. The center of the basket is provided with a generally vertically extending center post 60. The outer surface of the center post 60 is textured or contoured so as to minimize slippage between the center post outer surface and fabric articles being washed. In the illustrated embodiment this texturing takes the place of a number of slightly spaced apart vertically extending ribs 62 formed along the outer surface of the post 60. The center post 60 may be of two-piece construction in the same manner as the remainder of basket 30. It will be understood that the number of individual pieces used to form the basket is chosen for purposes of ease of manufacture and does not affect the operation of the basket.

The lower portion of the center post 60 and the lower portion of the outer wall 31 are interconnected by an annular bottom wall 64. The upper surface of the bottom wall is textured to maximize slippage between the upper surface and fabric articles such as by being smooth and formed of low friction material. The upper, or inner, surface of the bottom wall is contoured to slope downwardly substantially continuously from the lower edge of the outer wall to the lower edge of the center post. The bottom wall 64 and side wall 31 are provided with a number of openings or holes 65 for draining water from the basket 26 into the tub 24. The number, size and spacing of the opening 65 are not critical to the present invention so long as the fabric articles are maintained in a soaked condition while only those articles within the lower portion of the basket are immersed. That is, the general washing condition is that of a "slosh wash" as described in the aforementioned applications, with the fabrics in contact with the bottom wall of the basket being sufficiently immersed so as to lubricate the interface between those fabrics in the bottom wall 64.

Figure 2:
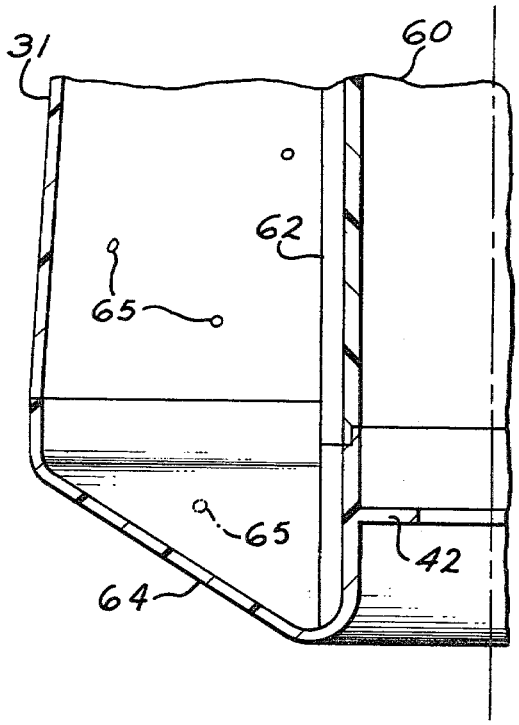
FIG. 2 is a sectionalized partial elevational view of the basket utilized in the washing machine of FIG. 1.
Figure 3:
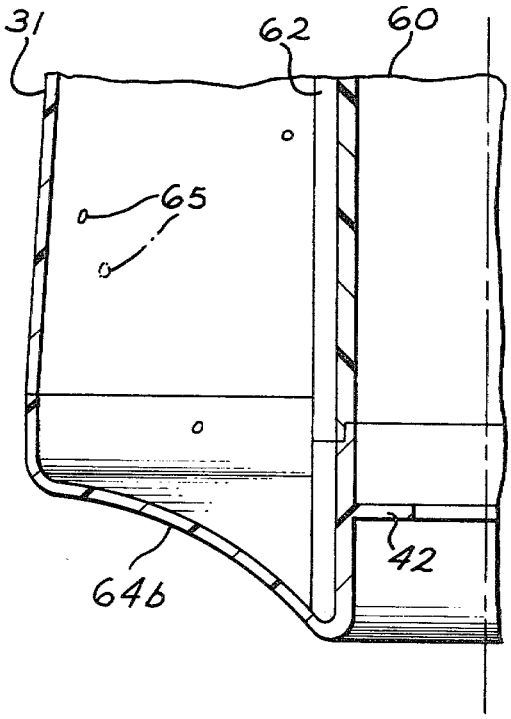
FIG. 3 is a sectionalized partial elevational view similar to FIG. 2 but showing a basket with a slightly modified bottom wall.
Figure 4:
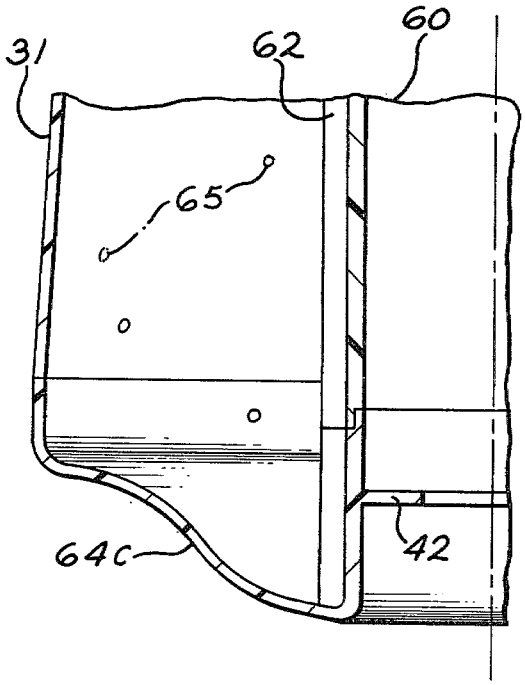
FIG. 4 is a sectionalized partial elevational view similar to FIG. 2 but illustrating yet another basket bottom configuration.
Figure 5:
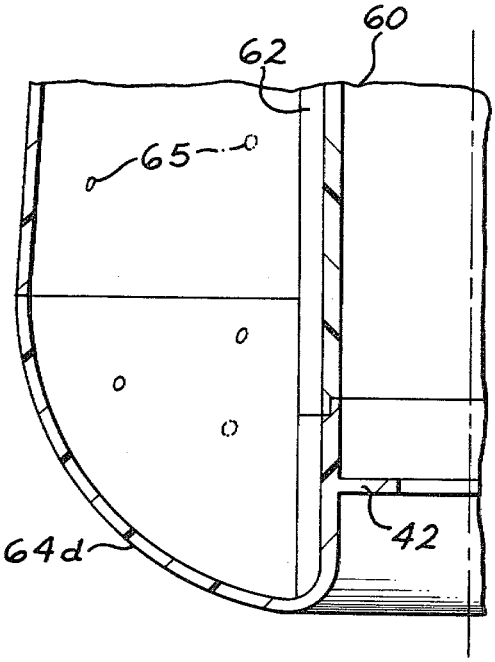
FIG. 5 is a sectionalized partial elevational view similar to FIG. 2 but showing yet another basket bottom configuration.

While it is important that the bottom wall slope substantially continuously from the lower portion of the outer wall to the lower portion of the center post, it is not necessary that the bottom wall be a uniform planar surface such as the frustoconical shape of the bottom wall 64 illustrated in FIGS. 1 and 2. Other bottom wall configurations 64*b*, 64*c* and 64*d* are illustrated in FIGS. 3, 4 and 5 respectively. Bottom walls 64*b* and 64*c* are convex, that is they curve inwardly and upwardly while bottom wall 64*d* is concave, that is it curves outwardly and downwardly. However, in each instance the bottom wall slopes downwardly substantially continuously from the outer wall to the center post. Thus fabrics will tend to slide inwardly to the center post.

Figure 6:
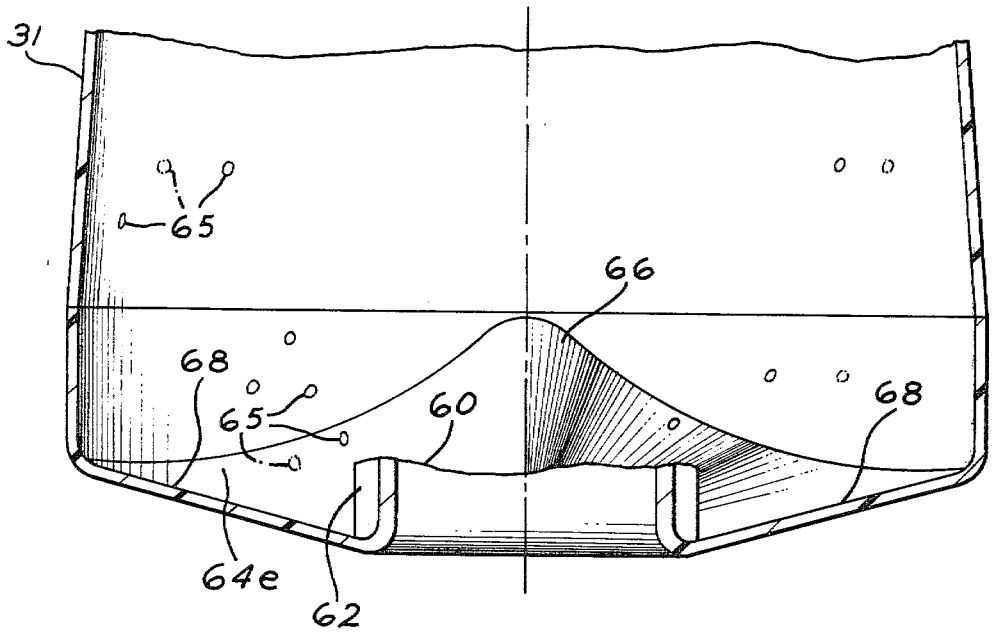
FIG. 6 is a partial elevational view in section of yet another basket configuration in which the bottom wall undulates circumferentially of the basket.
Figure 7:
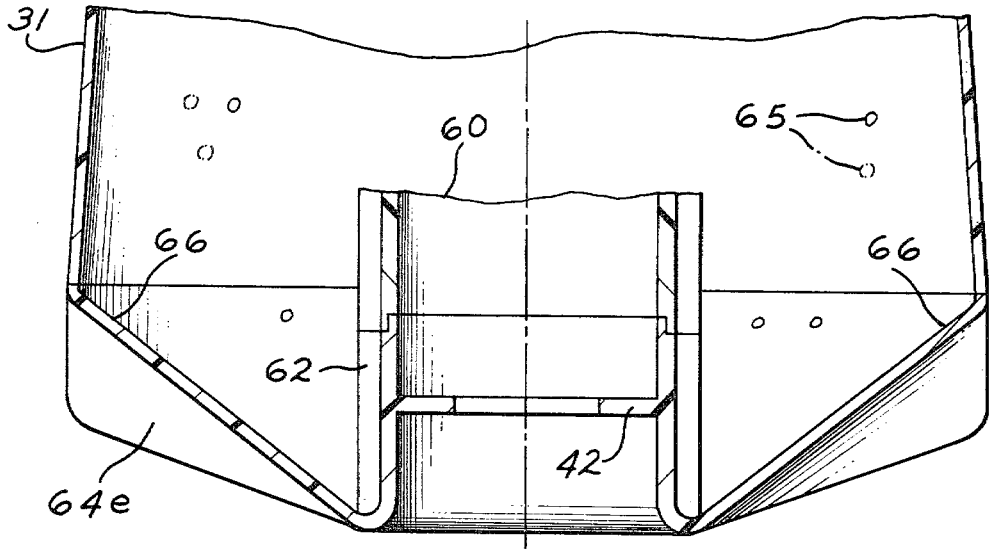
FIG. 7 is another sectionalized partial elevational view of the basket of FIG. 6 with the view being taken at right angles to the view of FIG. 6.

FIGS. 6 and 7 illustrate another, preferred form of the present invention in which the bottom wall portion 64*e* undulates circumferentially of the receptacle or basket. More particularly, in addition to sloping downwardly substantially continuously from the outer wall 31 to the center post 60, bottom wall 64*e* is contoured so as to have circumferentially alternate radially extending ridge areas, such as that indicated at 66, and radially extended valley areas, such as that indicated at 68. In a preferred embodiment, as illustrated, there are a pair of circumferentially opposed ridge areas 66 and a pair of circumferentially opposed valley areas 68. The inner surface of the wall portion 64 smoothly and continuously curves between the ridge areas and the valley areas.

During the washing and rinsing steps of machine operation the basket or receptacle 26 orbits about the axis of the transmission 34, and in the manner described in more detail in the aforementioned application, Ser. No. 142,949. As the central axis of the basket orbits about the input axis at a predetermined distance therefrom, the central axis describes a cylinder having a radius equal to the predetermined distance. Each point on the basket also describes a circle of a diameter equal to the diameter of the cylinder. With the inwardly sloping bottom wall portion 64, which includes bottom wall portions 64*a–e*, the fabrics in the bottom of the basket slide downwardly and inwardly into engagement with the center post. During washing and rinsing steps, the predominant energy transfer to the fabric load is through the frictional engagement between the center post and those fabrics in engagement with the center post. As the center post moves through its orbital path, there is a periodic change in the contact force between the fabric load and the adjacent portion of the center post, depending on the frequency and amplitude of orbit, on what part of the orbital circle the basket is transversing and on the inertia of the load. Thus, as a particular portion of the center post approaches the load, the contact forcing increases and, as the outer surface of the center post recedes from the adjacent portion of the load, those contact forces decrease. The vertical ribs 62 or other texturing of the center post is designed to minimize slippage between the fabrics and the center post so as to enhance the amount of force transmitted from the center post to the fabrics. In addition to inputting washing energy into the load, the cyclically variable force between the center post and the fabrics and the coefficient or friction at the interface between the center post outer wall in the fabric load causes the load to move annularly in the direction of the basket orbit. As the clothes load moves or precesses around the basket, the undulations of the bottom wall 64*e* cause the length of the circumferential path at any particular distance from the center post to change. This enhances successive opening and compression of the fabrics in the load and thus enhances both turnover of the load and redistribution of the individual fabrics within the load.

While a particular form of the present invention has been shown and described, it will be apparent that modifications of the structure shown and described may be made by those skilled in the art without parting from the invention. It is intended therefore, by the appended claims to cover all modifications which come within the spirit and scope of this invention.

What is claimed is:

1. In a washing machine for fabric articles comprising a receptacle to receive washing liquid and a fabric article load to be washed in the liquid, said receptacle having a generally vertical central axis; and drive means operatively connected to said receptacle and constructed and arranged to move said receptacle so that the central axis of said receptacle moves in an orbital path; said receptacle comprising:

(a) a generally upright circumferentially outer wall;

(b) a generally upright center post spaced radially inward of said outer wall and having a circumferentially outer surface for engaging fabric articles, said outer surface being textured to minimize slippage between said outer surface and fabric articles; and (c) an annular bottom wall interconnecting the lower ends of said outer wall and said center post, said bottom wall having an upper surface textured to maximize slippage between said upper surface and fabric articles, said upper surface being contoured to slope downwardly substantially continuously from said outer wall to said center post and to undulate circumferentially of said receptacle.

2. In a washing machine as set forth in claim 1, said annular bottom wall upper surface being contoured with circumferentially alternate radially extending ridge areas and radially extending valley areas.

3. In a washing machine as set forth in claim 2, wherein there are a pair of circumferentially opposed ridge areas and a pair of circumferentially opposed valley areas.

4. In a washing machine as set forth in claims 1, 2 or 3 further including means for supplying liquid to said receptacle and wherein said receptacle includes apertures for draining liquid from said receptacle, said receptacle apertures being sized relative to the supply of liquid to maintain said upper surface immersed in liquid.

* * * * *